US005612506A

United States Patent [19]

Goldstein

[11] Patent Number: 5,612,506

[45] Date of Patent: Mar. 18, 1997

[54] METHOD OF AND APPARATUS FOR GENERATING A HIGH PRESSURE GAS PULSE USING FUEL AND OXIDIZER THAT ARE RELATIVELY INERT AT AMBIENT CONDITIONS

[75] Inventor: Yeshayahu S. A. Goldstein, Gaithersburg, Md.

[73] Assignee: General Dynamics Land Systems, Inc., Sterling Heights, Mich.

[21] Appl. No.: 417,529

[22] Filed: Apr. 6, 1995

Related U.S. Application Data

[63] Continuation-in-part of Ser. No. 329,755, Oct. 26, 1994.

[51] Int. Cl.[6] ..... F42B 5/08

[52] U.S. Cl. ..... 102/472; 102/202.8; 102/430; 89/8

[58] Field of Search ..... 102/472, 202.5, 102/202.7, 430, 202.8, 440, 530, 531; 89/28.05, 8

[56] References Cited

U.S. PATENT DOCUMENTS

| | | | |
|---|---|---|---|
| 4,590,842 | 5/1986 | Goldstein et al. | 89/8 |
| 4,715,261 | 12/1987 | Goldstein et al. | 89/8 |
| 4,974,487 | 12/1990 | Goldstein et al. | 89/7 |
| 5,010,804 | 4/1991 | Lee | 89/8 |
| 5,012,719 | 5/1991 | Goldstein et al. | 89/8 |
| 5,072,647 | 12/1991 | Goldstein et al. | 89/8 |
| 5,444,208 | 8/1995 | Mortensen | 89/8 |

*Primary Examiner*—Michael J. Carone
*Attorney, Agent, or Firm*—Lowe, Price, LeBlanc & Becker

[57] ABSTRACT

A high pressure pulsed gas source for accelerating a projectile along a gun barrel comprises a structure including a high voltage electrode for establishing axial electrical discharges in corresponding axial gaps behind an outlet where the projectile is located. Plasma flows at right angles to the discharges into a propellant mass that is converted into a high pressure component of the gas pulse. The gaps are arranged so that after the projectile moves away from its initial position and is in the barrel, power applied to the plasma via gaps close to the outlet is greater than power applied to the plasma via gaps farther from the outlet. To avoid damage to the gun, the gaps are arranged so power applied to the plasma is substantially the same in the discharges when plasma is initially produced. The gaps include walls that are eroded differently by the discharges so gap walls close to the outlet erode faster than gap walls farther from the outlet. The propellant mass includes a solid fuel and an oxidizer that do not react at ambient conditions. A portion of the fuel abuts the structure and the fuel and oxidizer are vaporized and elevated to a sufficiently high temperature by the plasma as to produce an exothermic chemical reaction resulting in derivation of the high pressure gas pulse that is supplied to the projectile. The axial gaps are arranged so that the power applied to the plasma via gaps close to the projectile causes initial vaporization of the fuel closest to the projectile prior to vaporization of the fuel farther from the projectile and progressive vaporization of the fuel farther from the projectile.

27 Claims, 3 Drawing Sheets

METHOD OF AND APPARATUS FOR GENERATING A HIGH PRESSURE GAS PULSE USING FUEL AND OXIDIZER THAT ARE RELATIVELY INERT AT AMBIENT CONDITIONS

RELATION TO CO-PENDING APPLICATION

The present application is a continuation in part of co-pending commonly assigned application Ser. No. 08/329,755, filed Oct. 26, 1994, entitled HYBRID ELECTROTHERMAL GUN WITH SOFT MATERIAL FOR INHIBITING UNWANTED PLASMA FLOW AND GAPS FOR ESTABLISHING TRANSVERSE PLASMA DISCHARGE.

FIELD OF INVENTION

The present invention relates generally to high pressure pulsed gas sources particularly adapted to accelerate projectiles and, more particularly, to a high pressure pulsed gas source including a solid fuel and non-gaseous oxidizer that are relatively inert at ambient conditions and which are vaporized to produce the pulse.

BACKGROUND ART

High pressure pulsed gas sources derived by electrothermal techniques are disclosed, for example, in commonly assigned U.S. Pat. Nos. 4,590,842, 4,715,261, 4,974,487 and 5,012,719. Some of these prior art devices avoid the need for energetic chemicals that frequently become unstable and pose a constant safety problem. In these prior art pulsed gas sources, a capillary discharge is formed in a passage between a pair of spaced electrodes at opposite ends of a dielectric tube, preferably formed of polyethylene. In response to a discharge voltage between the electrodes, a high pressure, high temperature plasma fills the passage, causing material to be ablated from the dielectric wall. High temperature, high pressure plasma gas flows longitudinally of the discharge and the passage through an aperture defined by an electrode at one end of the passage. The gas flowing longitudinally from the passage through the aperture produces a high pressure, high velocity gas jet that can accelerate a projectile to a high velocity. In the '487 patent, the high pressure, high temperature plasma interacts with a propellant mass to produce a high temperature propellant. In the '719 patent, hydrogen is produced by interacting the plasma flowing through the orifice with a metal hydride and some other material to produce high pressure hydrogen. The plasma is cooled by interacting with a cooling agent, for example water, while an exothermal chemical reaction is occurring.

In the '487 patent, the pressure acting on the rear of a projectile is maintained substantially constant while the projectile is accelerated through a barrel bore even though the volume of the barrel bore between the high pressure source outlet orifice and the projectile increases. Such a result is attained by increasing the electric power applied to the capillary discharge in a substantially linear manner as a function of time.

In still a further high pressure pulsed gas source disclosed in commonly assigned U.S. Pat. No. 5,072,647, a high pressure plasma discharge is established between a pair of axially displaced electrodes. The pressure of the plasma in the discharge is sufficient to accelerate a projectile in a gun barrel bore. The plasma is established in a walled structure confining the discharge and having openings through which the plasma flows transversely of the discharge. A chamber surrounding the wall includes a slurry of water and metal particles to produce high pressure hydrogen gas that flows longitudinally of the discharge against the rear of a projectile. To maintain the pressure of the hydrogen gas acting against the projectile relatively constant as the projectile is accelerated down the barrel, electric power applied to the discharge increases substantially linearly as a function of time.

Some concepts employed in the '647 patent have been incorporated into the co-pending, commonly assigned application Ser. No. 08/238,433, filed May 5, 1994. In this co-pending application, a structure establishes at least several axial electrical discharges across axial gaps behind an outlet of a high pressure pulsed gas source, particularly adapted for driving a projectile. The discharges cause plasma to flow with components at right angles to the axial discharges. A conventional propellant mass, e.g. gunpowder, or a hydrogen producing mass, as disclosed in the '647 patent, is positioned to be responsive to the plasma flow resulting from the discharges. In response to the plasma resulting from the discharges being incident on the propellant mass, a high pressure gas pulse is produced.

Those working in the art have recognized that it is desirable for plasma accelerating a projectile to have a maximum amount of pressure close to the base, i.e., rear, of the projectile. Hence, after a projectile is initially accelerated, it is desirable for the power close to the projectile, at the front of a plasma source, to be greater than the power at the rear of the plasma source. However, a problem in producing a plasma with such a power or energy distribution is that pressure waves have a tendency to be produced in the plasma source. The pressure waves from a high pressure plasma source, such as derived from a highly energetic electric power supply (having millions of Joules of energy), can be destructive of a projectile launcher including such a high pressure source. It is, therefore, desirable for a high pressure plasma source having at least several axial electrical discharges to initially produce plasma having about the same power over all of the gaps. After the projectile has moved away from its initial position, it is then desirable for the power applied to the plasma close to the projectile to exceed the power of the plasma farther from the projectile.

A problem with the aforementioned types of devices is that the plasma has a tendency to flow through a plasma confining structure to an electrode needed to establish the axial electrical discharges; the electrode must be at a high voltage relative to metal parts close to it. If the plasma has a high temperature at the time it is incident on the electrode, many charge carriers are incident on the electrode, causing a low impedance electric path to subsist between the electrode and the metal parts. This constitutes a parallel current path to the desired discharges, diverting current away from the desired discharges. The original electric discharges thus have a tendency to be quenched. To overcome this problem in the past, it has been the general practice to design the structure so the electrode is a great distance from the discharge structure. Such an arrangement enables the high temperature of the plasma to be largely dissipated to reduce the number of plasma charge carriers incident on the electrode. However, such a lengthy structure is not conducive to optimum design of cartridges including projectiles adapted to be loaded into military hardware.

Many of these problems are considered and solved in the co-pending, commonly assigned application of Goldstein et al. (08/329,755 entitled "HYBRID ELECTROTHERMAL GUN WITH SOFT MATERIAL FOR INHIBITING UNWANTED PLASMA FLOW AND GAPS FOR ESTABLISHING TRANSVERSE PLASMA DISCHARGE," filed Oct. 26, 1994. In that application, there is disclosed a high pressure pulsed gas source, particularly adapted to accelerate a projectile along a gun barrel. The source comprises a structure for establishing at least several axial electrical discharges in corresponding axial gaps behind an outlet; the projectile is initially located immediately in front of the outlet. The discharges cause plasma to flow with components at right angles to the axial discharges for a substantial time while the pulse is being derived and while the projectile is traversing the barrel. A propellant mass positioned to be responsive to the plasma flow resulting from the discharges is converted into a high pressure component of the gas pulse by the plasma. The axial gaps are arranged so that after the pulse is initially formed and is still being derived, i.e., after the projectile moves away from its initial position and is in the barrel, the power applied to the plasma via gaps close to the outlet is greater than the power applied to the plasma via the gaps farther from the outlet. Thereby, greater power and pressure are applied to the base of the projectile, to accelerate the projectile more efficiently and to higher velocities.

To avoid damage or destruction to a structure for deriving the high pressure gas pulse, e.g., the gun including the barrel, the axial gaps are arranged so that when the plasma is initially produced and the pulse is initially derived, the power applied to the plasma is substantially the same in the several discharges.

Preferably, the gaps include walls that erode differently in response to the discharges so that during the application of power to the gaps, the walls of the gaps close to the outlet and projectile erode faster than the walls of the gaps farther from the outlet and projectile. Initially, the power developed in all of the gaps is approximately the same. After a particular discharge structure has been used once, it is discarded, as is common for the accelerating portions of projectile cartridges.

In one embodiment, the walls of the gaps close to the projectile have a smaller radius than walls of the gaps farther from the projectile, to cause greater erosion of the gaps close to the projectile than the walls of the gaps farther from the projectile. A similar result is achieved by arranging the walls of the gaps close to the projectile to be axially closer to each other than the walls of the gaps farther from the projectile. Greater uniformity of the initial application of power to the gaps is provided by combining the two aforementioned factors, i.e., by arranging the walls of the gaps close to the projectile to have a smaller radius than the walls of the gaps farther from the projectile and arranging the walls of the gaps close to the projectile to be closer to each other than the walls of the gaps farther from the projectile. The gap length and wall radii can be changed gradually from gap to gap or half of the gaps close to the outlet can have the same first configuration while the gaps remote from the outlet can have a second configuration which differs from that of the first configuration.

The use of gaps having different geometries is predicated on the proposition that during a discharge, all of the gap lengths increase. The increase in length of the smaller gaps is greater than the increase in length of the larger gaps. Thus, there is a shift in the plasma power toward the front of the plasma source where the small gaps are located. In a similar manner, as the radial length of the gap walls increases, the resistance of the plasma in the gap decreases, resulting in lower power dissipation in the gap for equal length gaps. The decreased power dissipation in the gaps having the thicker walls results in less erosion from these walls and thereby causes less erosion of the thicker walls farther from the projectile than the thinner walls closer to the projectile.

Preferably, each wall is part of a member having an outer periphery beyond the wall. The outer periphery is formed of a non-electrically conducting material that is eroded by the plasma at a rate which is slower than the wall material. The outer periphery thus retains its geometry during the discharge so plasma incident on the outer surface thereof does not change the discharge structure. This feature also provides predictable plasma flow characteristics from the discharge structure into the propellant.

The electrical power supply connected to the structure enables the pressure applied to the projectile to remain approximately constant while the projectile is being accelerated in the barrel, even though the volume in the barrel between the outlet of the high pressure source and the base of the projectile is increasing. To these ends, the power supply initially produces a high power electric pulse to initially apply a high pressure plasma from the several discharges to the projectile. Then, after the projectile has moved away from its initial position, a smaller amount of electric power is applied to the gaps. At this time, the stored potential energy in the propellant mass is converted into pressure that is applied to the projectile via the barrel. Electric power applied to the gaps is then ramped upwardly to increase the plasma pressure and the pressure resulting from the converted propellant mass, such that the total pressure applied to the projectile remains approximately constant from a moment shortly after the discharge is initially generated to the end of the discharge, typically about 1,000 microseconds after the initial discharge occurs.

In this prior art structure, the propellant mass is described as gunpowder. Hence, the safety advantages of the earliest electrothermal devices are not included in the structure of the co-pending application. In addition, the prior art use of gunpowder is not particularly efficient because a fraction of the gunpowder burns too late to affect pressure on the projectile base. Also, the electrical energy may be supplied too late into the pulse, that is during a later portion of the pressure pulse when the pressure gradually drops toward zero.

It is, accordingly, an object of the present invention to provide a new and improved apparatus for and method of deriving a high pressure gas pulse, particularly adapted to drive a projectile in a gun barrel.

Another object of the invention is to provide a new and improved cartridge including a projectile and an electrothermal structure for driving the projectile to high speeds in a gun barrel.

A further object of the invention is to provide a new and improved method of deriving a high pressure gas pulse from a mass of non-gaseous material that is relatively inert, hence safe, at ambient conditions, and which is vaporized and chemically reacted such that a relatively large percentage of the potential energy thereof is converted to kinetic energy.

An additional object of the invention is to provide a new and improved electrothermal apparatus including at least several axially displaced gaps for deriving a plasma that flows radially with respect to a structure including the axial gaps wherein the apparatus employs a propellant mass that is relatively inert at ambient conditions and a very high percentage thereof is converted to kinetic energy.

A further object of the invention is to provide a new and improved cartridge including a projectile attached to a structure for deriving at least several axially spaced plasma jets that flow into a propellant mass that is radially displaced from the structure and is relatively inert at ambient conditions, but has a high percentage of its potential energy converted to kinetic energy.

THE INVENTION

In accordance with one aspect of the invention, an apparatus for accelerating a projectile along a gun barrel having a longitudinal axis comprises a structure for establishing at least several axial gaps for providing at least several axial electrical discharges behind the projectile. The discharges cause plasma to flow with components at right angles to the axial discharges for a substantial time while the projectile is traversing the barrel. A propellant mass positioned to be responsive to the plasma flow resulting from the discharges is converted into a high pressure gas for accelerating the projectile in the barrel in response to the plasma resulting from the discharges being incident on the propellant mass. The propellant mass includes a solid fuel and an oxidizer that do not react at ambient conditions, wherein a portion of the fuel abuts the structure. The fuel and oxidizer are vaporized and elevated to a sufficiently high temperature by the plasma as to produce an exothermic chemical reaction resulting in derivation of the high pressure gas pulse that is supplied to the projectile. The axial gaps are arranged so the power applied to the plasma via gaps close to the projectile causes initial vaporization of the fuel closest to the projectile prior to vaporization of the fuel farther from the projectile and progressive vaporization of the fuel farther from the projectile. This apparatus is preferably incorporated into a cartridge including the projectile.

Preferably, the gaps are arranged so greater power is applied to gaps close to the projectile than is applied to gaps farther from the projectile. In addition, the fuel mass is a solid confined to a region in proximity to the discharges and the oxidizer is in a second region radially beyond the confined region where the fuel is located. The oxidizer may be a liquid in the confined and second regions or a solid confined to the second region. The fuel is preferably a powder confined by a screen having a mesh less than the size of grains of the powder. The confined fuel mass preferably decreases in cross sectional area along the structure as distance of the structure from the projectile increases. In a preferred embodiment, the gaps include walls that erode differently in response to the discharges so that the walls of the gaps close to the projectile erode faster than the walls of the gaps farther from the projectile. The walls are on rings coaxial with an axis of the structure and that have diameters such that rings close to the projectile have smaller diameters than rings remote from the projectile. The screen has a cylindrical constant diameter wall coaxial with the rings. Such an arrangement provides a nozzle-like effect for transporting fuel and oxidizer to an outlet for directing the high pressure pulse to the projectile.

In a preferred embodiment, walls of the gaps include a solid material, e.g. carbon, that is vaporized by the discharge and exothermally reacts chemically with the oxidizer to produce a portion of the high pressure gas pulse that is applied to the projectile.

Another aspect of the invention relates to an apparatus for supplying a high pressure pulse of gas along a longitudinal axis to an outlet port. The apparatus comprises a structure for establishing at least several axial gaps for providing at least several axial electrical discharges behind the outlet port. The discharges cause plasma to flow with components at right angles to the axial discharges. A propellant mass positioned to be responsive to the plasma flow resulting from the discharges is converted into a component of the high pressure gas pulse by the plasma flow. The gaps include walls that erode differently in response to the discharges so that the walls of the gaps close to the outlet erode faster than the walls of the gaps farther from the outlet. The propellant mass includes a solid fuel and an oxidizer that do not react at ambient conditions, wherein a portion of the fuel abuts the structure. The fuel and oxidizer are vaporized and elevated to a sufficiently high temperature by the plasma as to produce an exothermic chemical reaction resulting in derivation of the high pressure gas pulse that is supplied to the outlet. This apparatus is preferably used to accelerate projectiles, particularly projectiles included in cartridges containing the apparatus.

A further aspect of the invention relates to a method of supplying a high pressure gas pulse to an outlet by chemically reacting a solid fuel with a non-gaseous oxidizer by initially vaporizing the fuel in closest proximity to the outlet and then progressively vaporizing the fuel farther from the outlet and by vaporizing the oxidizer. The oxidizer and fuel are simultaneously in a vapor state during the reaction. The reaction is such that initially high pressure gaseous reactants of the fuel closest to the outlet and the oxidizer are applied to the outlet; as time progresses, high pressure gaseous reactants of the fuel farther from the outlet and the oxidizer are applied to the outlet. The fuel and oxidizer are not chemically reactive at ambient conditions.

Preferably the fuel is vaporized by applying plasma resulting from an electric discharge to the fuel. The electric discharge is such that greater power is in the plasma close to the outlet than is in the plasma farther from the outlet. Preferably, the fuel is selected from the group consisting essentially of polyethylene, carbon, triethanolammonium nitrate (TEAN), cellulose acetate butyrate (CAB) and hydrazine borane and the oxidizer is selected from the group consisting essentially of solid AN, $KClO_4$, $NaClO_4$, an aqueous solution of AN, liquid hydroxyl ammonium nitrate (HAN) and a solution including $H_2O_2$. In a preferred embodiment, the fuel and oxidizer respectively include polyethylene and ammonium nitrate which are vaporized and chemically react to produce the high pressure pulse in accordance with:

$$CH_2+3NH_4NO_3 \rightarrow CO_2+7H_2O+3N_2+\text{heat}.$$

Alternatively or additionally, the fuel preferably includes carbon which is vaporized and chemically reacts with the ammonium nitrate to produce the high pressure pulse in accordance with:

$$C+2NH_4NO_3 \rightarrow CO_2+2N_2+4H_2O+\text{heat}.$$

The above and still further objects, features and advantages of the present invention will become apparent upon consideration of the following detailed description of one specific embodiment thereof, especially when taken in conjunction with the accompanying drawings.

DESCRIPTION OF THE PREFERRED EMBODIMENT

Figure 1:
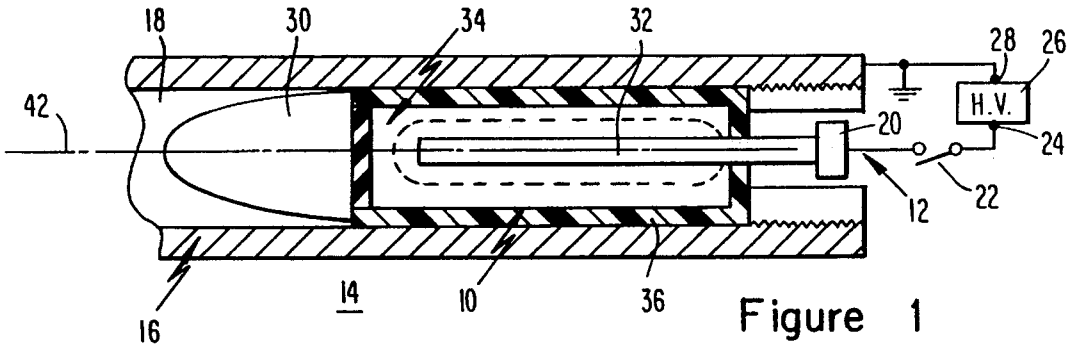
FIG. 1 is a side sectional view of a cartridge incorporating the present invention, as loaded in a gun barrel.

Reference is now made to FIG. 1, wherein cartridge 10, having a circular cross section and coaxial with axis 42, is illustrated as being loaded in breech 12 of gun 14 including metal barrel 16 surrounding cylindrical bore 18. When cartridge 10 is in place, high voltage electrode 20 of the cartridge is selectively connected via switch contacts 22 to high voltage terminal 24 of highly energetic DC pulse power supply 26, having a grounded power supply terminal 28 connected to the exterior metal wall constituting barrel 16. Typically, power supply 26 produces sufficient energy to accelerate projectile 30 of cartridge 10 in and through bore 18. Power supply 26 causes cartridge 10 to produce a high pressure plasma pulse which is coupled to a propellant mass 31 including fuel mass 34 and oxidizer mass 35. Propellant mass 31 releases chemical energy which produces a pressure pulse that is combined with the plasma pressure to drive projectile 30. A typical energy level of supply 26 is on the order of 0.4–1.6 megaJoules for a 30 mm gun and the peak voltage of the supply is in the 4 to 20 kilovolt range, delivering a power near one gigawatt.

Cartridge 10, in addition to including projectile 30, includes discharge structure 32, having circular cross sections and coaxial with axis 42, for generating the high pressure, highly energetic plasma in response to switch 22 being closed. The discharge structure is surrounded by solid, preferably powder, fuel mass 34. Fuel mass 34 is quite inert at ambient conditions, i.e., atmospheric pressure and temperatures in the range of −40° C. to +50° C., and is confined by non-metallic screen 33 in close proximity to structure 32 and extends along the complete length of the structure, except for the extreme tip of the structure. A preferred material for fuel 34 is polyethylene although other materials, e.g., carbon, TEAN, CAB and hydrazine borane, can be employed.

Screen 33, having an electrically insulating mesh finer than the sizes of the powder of fuel mass 34, has a cylindrical side wall 37, coaxial with axis 42 and that surrounds discharge structure 32. Screen 33 has a base anchored to electrical insulating block 106 and a planar end plate 39 aligned with and abutting electrically insulating washer 80 at the forward end of discharge structure 32. Screen 33 is vaporized late in the electrical pulse by the high temperature resulting from the plasma being produced by structure 32.

A solid or liquid oxidizer mass 35 that is very safe to handle and does not react with fuel 34 under ambient conditions or normal handling by military personnel contacts the fuel within screen 33, surrounds the screen and generally fills the volume within electrically insulating cartridge and housing 36, forward of electrical insulating block 106. Alternatively, all of the solid oxidizer mass 35 can be outside of screen 33, a configuration that is somewhat safer than having the fuel and oxidizer masses in contact. Typical materials for oxidizer mass 35 are solid ammonium nitrate ($NH_4NO_3$, referred to as AN), solid $KClO_4$, solid $NaClO_4$, an aqueous solution of AN, liquid HAN, and $H_2O_2$ in solution with water; typically the $H_2O_2$-$H_2O$ solution is such that there is about 65% by weight of $H_2O_2$. Fuel mass 34 is converted into a high pressure, relatively low temperature gas and the oxidizer is vaporized and decomposed into its constituent molecules by the plasma derived by structure 32. The decomposed oxidizer and fuel chemically react to produce a low atomic weight energetic gas for accelerating projectile 30.

For the preferred embodiment wherein the fuel is $CH_2$ and the oxidizer is $NH_4NO_3$, the chemical reaction is $CH_2+3NH_4NO_3 \rightarrow CO_2+7H_2O+3N_2+5.2$ kJ/gram of reactant.

It can be shown that in a 120 mm. cartridge wherein AN is compacted to 1.55 g /cm$^3$ and $CH_2$ has a density of about 1 g/cm$^3$, there are 8.7 liters of AN and 0.8 liter of $CH_2$ having a total weight of 14.3 kg and a chemical potential energy of 74 MJ which is converted into about 17 MJ of kinetic energy in response to between 0.6 and 1.6 MJ of electrical energy being applied by supply 26 to structure 32.

Because fuel mass 34 and oxidizer mass 35 are very stable and cannot chemically react until sufficient electrical energy is applied to discharge structure 32, cartridge 10 can be made and handled somewhat carelessly. Typically, an electrical energy of 1–2 kJ/g of fuel mass 34 is required from structure 32 to convert the fuel mass into a vapor. Because oxidizer mass 35 freely decomposes early during a pulse applied to discharge structure 32, there is no risk in excessively high, possibly destructive pressure being developed in barrel 16.

Structure 32 is arranged so fuel in the forward end of cartridge 10, i.e., closest to the base of projectile 30, is vaporized prior to fuel in the middle and rearward portions of the cartridge. The fuel is thereby metered to projectile 30 to assist in maintaining a high pressure against the projectile throughout the time while the projectile is being accelerated through barrel 16. A power pulse coupled by source 26 to structure 32 and the physical configuration of the discharge structure are such that the fuel is properly converted into gas and metered. It is important for fuel mass 34 to be confined so it is in close proximity to structure 32, as is achieved by screen 33, to assure controlled vaporization of the fuel mass.

Polyethylene and ammonium nitrate are respectively the fuel and oxidizer of choice because of the safety aspects thereof. In addition, once vaporized, they are much more energetic than gunpowder or similar prior art propellants. The reaction products of polyethylene and ammonium nitrate have greater density than that of gunpowder or similar prior art propellants so the reaction products can apply a given pressure (the barrel can sustain) to the projectile for a significantly longer time, for cartridges of the same volume. The polyethylene and ammonium nitrate substantially reduce the plasma temperature so barrel 16 is not damaged by the plasma.

In response to the high pressure plasma initially derived from structure 32 being initially converted by masses 34 and 35 into high pressure gas, projectile 30, initially fixedly attached to frangible end face 104 of cartridge housing 36, is accelerated away from structure 32. When end face 104 is broken by the pressure from the plasma, an outlet is provided for the high pressure gas pulse derived from the chemical and electrical sources. Projectile 30 is thereafter propelled down bore 18 of barrel 16.

Figure 2:
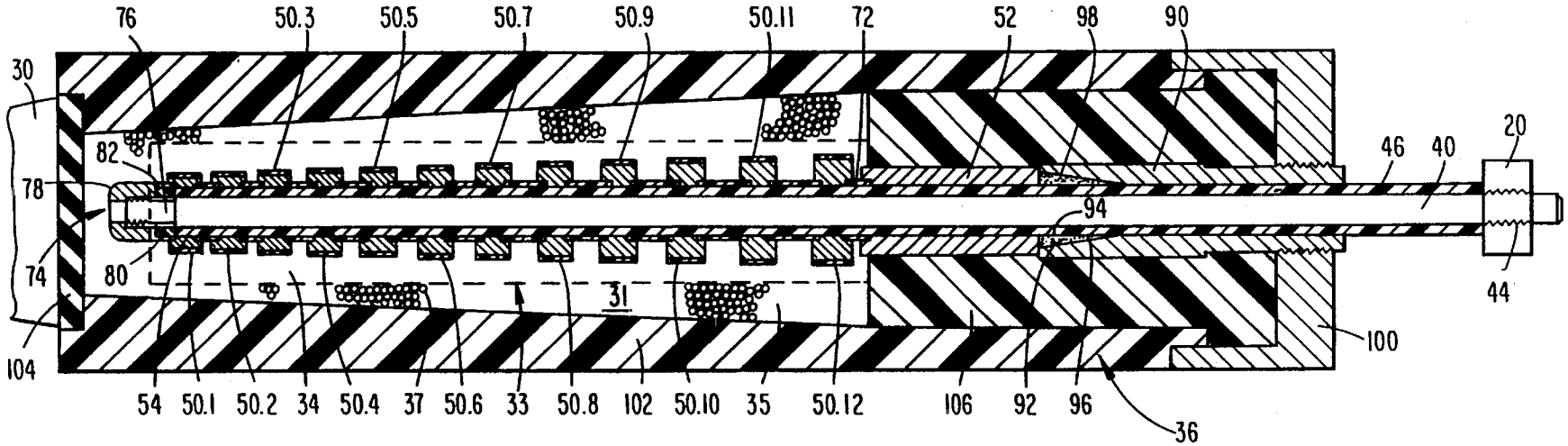
FIG. 2 is a side sectional view of a preferred embodiment of the cartridge illustrated in FIG. 1.

As illustrated in FIG. 2, cartridge 10 includes axially extending metal rod 40 that is coaxial with longitudinal axis 42 of barrel bore 18. One end of metal rod 40 extends rearwardly of back metal end wall 100 of cartridge case 36 and includes threads 44 on which cylindrical metal electrode 20 is screwed, for the selective application of high voltage from terminal 24 of high voltage supply 26. Metal rod 40 is surrounded by electrical insulating tube 46 for virtually its entire length, between electrode 20 and the end of the metal rod proximate projectile 30. The outer diameter of rod 40 is suitably bonded, for example, by glue, to the inner diameter of tube 46.

Figure 3:
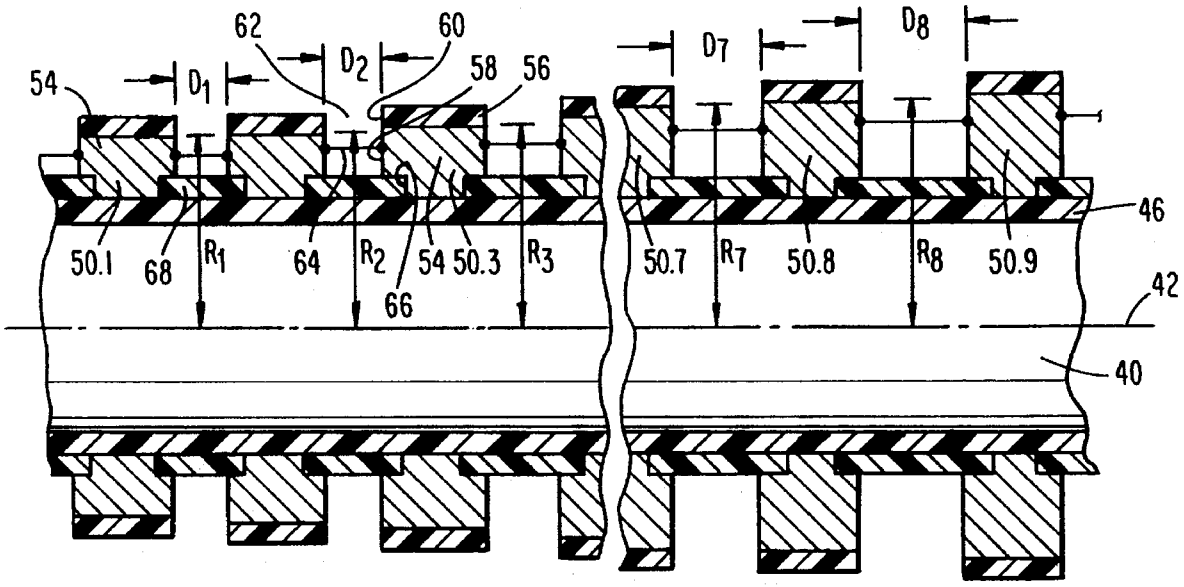
FIG. 3 is a detailed view of a portion of the cartridge illustrated in FIG. 2.

A structure for deriving at least several, e.g., 13, axial discharges in the direction of axis 42 includes axially displaced rings 50.1–50.12 and metal sleeve 52, all of which are coaxial with, bonded to and surround insulating tube 46. (When all of rings 50.1–50.12 are referred to in a general manner, or collectively, they are referred to herein as rings 50 or each of rings 50.) As illustrated in detail in FIG. 3, each of rings 50 includes a metal, preferably carbon, interior portion 54 having an outer circular wall (in cross-section) bonded to the interior cylindrical wall of electrically insulating annular outer portion 56. The metal portion 54 of each of rings 50 includes a radially extending wall 58 that is aligned with a corresponding radially extending wall 60 of annular portion 56. Annular portion 56 is made of a material (e.g., KAPTON or LEXAN) that erodes at a much slower rate than metal wall 58 in response to an electric discharge established in gap 62 between adjacent, facing metal walls 58 of adjacent rings 50. To minimize the initial power supply requirements of high voltage source 26, fusible metal wire 64 (in FIG. 3) extends between and is connected to the facing walls of metal portions 54 of adjacent rings 50. Wire 64 ruptures in response to the initial application of power by supply 26 to electrode 20 in response to closure of switch 22.

Each of rings 50 includes axially extending notch 66 along its interior circumferential wall. Each of notches 66 extends from wall portion 58 toward the axial center of each of rings 50 through a distance in excess of the erosion of wall 58 during application of electric energy from power supply 26 to electrode 20. The space between facing walls of notches 66 of a pair of adjacent rings 50 is filled by axially extending electrically insulating washers 68 having axial end and circumferential walls that bear against the end and circumferential walls of notches 66, to hold rings 50 in place, while maintaining discharge gap 62. A similar notch 70 is provided in the end of sleeve 52 adjacent ring 50.12 and is filled by electrically insulating washer 72, to provide a gap between ring 50.12 and sleeve 52 that is basically the same as the discharge gap between adjacent, facing walls 58 of rings 50.11 and 50.12.

The entire assembly of rings 50 and washers 68, as well as washer 72, is held in place by assembly 74 at the end of metal rod 40 proximal projectile 30. Assembly 74 also provides an electrical path from metal rod 40 to the metal portion 54 of ring 50.1 and a further axial discharge gap to ring 50.2. To these ends, the end of metal rod 40 proximal projectile 30 is threaded to metal thimble 78, having a shoulder which bears on electrically insulating washer 80. The shoulder of thimble 78 also bears against an end face of electrical insulating tube 82 that is identical to washers 68 and concentric with and bonded to washer 80. The other end face of tube 82 fits into notch 66 at the forward end of ring 50.1 against an end face of tube 46. One end of washer 80 abuts the end face of tube 46. Thimble 78 is turned sufficiently so pressure is exerted by the shoulder of the thimble on tube 82, thence on the wall of notch 66 of ring 50.1 that is proximal projectile 30, to drive all of the notches of rings 50 into engagement with the corresponding surfaces of electrically insulating washers 68, to press washer 72 against the wall of notch 70 in sleeve 52. Since sleeve 52 is glued to metal rod 40, the entire assembly of rings 50 and washers 68 is held in place.

To complete the electric path for the current flowing through the axial gaps 62 between wall portions 58 of rings 50, the end wall of sleeve 52 remote from the rings abuts against and is bonded to an abutting end wall of metal sleeve 90, having an interior cylindrical wall adhesively bonded to the exterior wall of insulating tube 46. The end of sleeve 90 abutting sleeve 52 includes chamber 92 formed as a pocket having axially extending wall 94 and tapered wall 96. Hence, pocket chamber 92 has an open end at the intersection of the end faces of sleeves 52 and 90 and a closed end at the intersection of walls 94 and 96. Wall 96 is tapered from the end of sleeve 90 closest to sleeve 52 toward electrode 20, at the end of metal rod 40. Chamber 92 is filled with a soft, non-electrically conductive solid mass 98, such as petroleum jelly. (A soft material is defined as a material having a Poisson ratio of approximately 0.5, such that a unit change in length of the material is approximately equal to a unit change in width of the material in response to a force that is applied to the material in the direction of the length of the material; a soft material acts like a water bag when it is compressed.)

Plasma produced in discharge gaps 62 generally flows radially outward into fuel mass 34 and oxidizer mass 35 that surround discharge structure 32. However, some of the plasma has a tendency to flow axially of the discharge structure and axis 42 toward electrode 20. If electrode 20 is sufficiently close to the plasma flowing from the discharge toward it and chamber 92 and mass 98 were not included, a relatively low electric impedance path would be provided from electrode 20 to grounded metal sleeves 52 and 90, which are part of the return path for the current flowing from the high voltage terminal of power supply 26 to barrel 16. If such a low impedance path extends from electrode 20 to barrel 16, the amount of energy supplied to the discharge gaps between rings 50 is insufficient to provide proper operation of the high pressure gas source which accelerates projectile 30 in bore 18. In the prior art, generally such short circuits were prevented by making the cartridge sufficiently long so plasma incident on the high voltage electrode was relatively cool, having few energetic charge carriers to establish a high impedance path from the electrode to the grounded gun barrel. A disadvantage of such an approach, however, is the relatively long cartridge length.

The soft, electrically insulating mass 98 loaded into chamber pocket 92 enables cartridge 10 to be relatively short. Chamber 92 and mass 98 are in the flow path of the plasma from rings 50 to electrode 20, along the abutting circumferences of tube 46 and sleeve 90. In response to the high pressure of the plasma (e.g., several kilobars), the soft material (1) compresses axially toward the rear of chamber 92, where walls 94 and 96 meet, and (2) expands radially against walls 94 and 96. Thereby, a high electrical impedance seal is provided in the plasma flow path which tends to exist from rings 50 to electrode 20 via the "abutting end" surfaces of tube 46 and sleeve 90.

To complete the electric discharge path for the current to the negative terminal of power supply 26, the cartridge case includes steel stub case 100 that is threaded to the end of metal sleeve 90. The outer cylindrical wall of stub case 100 abuts the interior cylindrical wall of metal barrel 16 to complete the circuit for high voltage supply 26 when switch 22 is closed.

The remainder of the cartridge case is formed of electrically insulating tube 102 having electrically insulating, frangible end wall 104. The exterior cylindrical wall of tube 102 abuts the interior wall of barrel 16 and, in this abutting position, has sufficient thickness to withstand the pressure produced by the plasma discharges established in gaps 62 and the pressure produced by propellant mass 34 which surrounds and is in front of the discharge structure. Frangible end wall 104, to which projectile 30 is attached, is ruptured by the high pressure produced by the chemical reaction of fuel mass 34 and oxidizer mass 35 in response to vaporization thereof by the high pressure plasma derived from the discharges in gaps 62. The region behind propellant mass 31 to the end wall of stub case 100 is filled by plastic, electrically insulating, solid filler 106.

Fuel mass 34 and oxidizer mass 35 are packed into the region of cartridge 10 from end wall 104 to a region slightly behind gap 62 between ring 50.12 and sleeve 52 to provide a flow path for the plasma established in gaps 62 against the rear end wall, i.e., base, of projectile 30. After the discharge plasma between gaps 62 is established, the plasma flows radially from the gaps, transverse to the discharges in gaps 62. Then the plasma flows through fuel mass 34 and oxidizer mass 35, generally parallel to axis 42, causing end wall 104 to rupture and accelerate projectile 30. The high temperature, high pressure plasma interacts with fuel mass 34 and oxidizer mass 35 to vaporize them and provide another high pressure gas component that flows generally parallel to axis 42 against projectile 30. The gas components from the plasma and the reaction products of the vaporized fuel and oxidizer masses combine to drive projectile 30 down barrel 16 at high speed.

To maximize efficiency in transferring power from the pulsed pressure source including the axial discharges in gaps 62 and the pressure of the reactants produced by the chemical reaction of fuel mass 34 and oxidizer mass 35, it is desirable to provide a very high pressure close to the base of projectile 30 while the projectile is in the barrel a substantial distance from its initial position. Such a high pressure is achieved by applying a significantly greater amount of power to gaps 62 of discharge structure 32 that are close to the projectile than is applied to the gaps that are farther away from the projectile, after projectile 10 has moved substantially from its initial position and is traversing barrel 16. However, if there is substantially more power in the front gaps 62 than in the remaining gaps when there is a small volume behind projectile 30 (at the time the projectile is initially accelerated and for several microseconds thereafter), substantial differential pressure waves are produced in this small volume. The substantial differential pressure waves can be of such magnitude as to have deleterious effects or be destructive of the high pressure gas containment structure in gun 14.

To resolve this problem, approximately the same power is initially applied to each gap 62 between rings 50.1–50.12 and the gap between ring 50.12 and sleeve 52. Gaps 62 are arranged so they have differential erosion properties as a function of time during the discharges in the gaps. The erosion properties are such that a greater amount of power is dissipated in the front gaps than is dissipated in the rear gaps after projectile 30 has moved sufficiently down barrel 16 so the differential pressure waves do not have an adverse effect on the barrel gas pressure confining structure. Because the differential pressure is distributed over a relatively large area of the interior walls of bore 16, the deleterious or destructive effects on the confining structure do not occur.

The differential erosion effect is provided by forming the metal portions 54 of each of rings 50 of the same material, preferably carbon, and by progressively changing the geometry of the walls of the metal portion from the forward gaps to the rear gaps. The geometries are such that initially (immediately after rupture of fuse wires 64), the electrical resistance in each gap 62 is approximately the same, which causes approximately equal power dissipation in each gap. As time progresses during a discharge, there are greater erosion and power dissipation in the forward gaps 62, e.g., between rings 50.1 and 50.2, than in the rear gaps, e.g., between rings 50.12 and sleeve 52. The lengths of the gaps 62 in the embodiment of FIG. 3 progressively decrease so the shortest gap is between rings 50.1 and 50.2, the next shortest gap is between rings 50.2 and 50.3, the longest gap is between rings 50.12 and sleeve 52 and the next longest gap is between rings 50.11 and 50.12, etc. In addition, the metal areas of the walls of the short forward gaps are progressively less than the metal areas of the walls of the longer rear gaps, a result provided by forming the radius of the metal portion of the gap formed by metal rings 50.1 and 50.2 so it is smaller than the radius of the metal portion 54 of rings 50.2 and 50.3, by forming the radius of the metal portion of the gap formed by metal rings 50.2 and 50.3 so it is smaller than the radius of the metal portion 54 of rings 50.3 and 50.4, etc. With the stated geometry, the initial resistance in each of gaps 62 is approximately the same, so the power dissipation in each of the gaps is also about the same at the beginning of a discharge.

As time progresses during a discharge there is greater erosion from walls 58 of metal portions 54 of the most forward gap 62 between rings 50.1 and 50.2 than in any of the other gaps. This is because there is much greater erosion of the metal in the most forward gap than in the other gaps. The resistance, power dissipation and erosion rate of the small radius, narrow, most forward gap are larger than those of the larger radius gaps to the rear of the most forward gap because (1) the squared relationship between diameter and surface area causes the resistance of the most forward gap to be larger by a factor equal to the square of the ratio of the radial thicknesses compared to the resistance of the gaps to the rear of the most forward gap, which in turn causes the power dissipation in the most forward gap to be the fourth power of the gaps to the rear of the most forward gap and (2) greater energy is dissipated in the narrow most forward gap than the longer gaps to the rear of the most forward gap. Hence, as time progresses during a discharge, greater power is initially applied to the portion of fuel mass 34 closest to projectile 30 than is applied to the fuel mass segment farther away from the projectile.

Because the forward rings 50 have a smaller radius than the rings behind them and screen 33 has a constant radius, there is more fuel in the forward part of the cartridge, where power dissipation is greatest, than in the rear of the cartridge. This arrangement enables the greatest amount of pressure to be developed in closest proximity to projectile 30 and assists in enabling the rate of fuel vaporization to approach the ideal relationship of being linear as a function of time. By providing a linear fuel vaporization vs. time relation, the peak pressure in barrel 18 can be controlled to prevent barrel damage and projectile acceleration can be maintained constant while the projectile remains in the barrel.

While it is desirable for the gap length and gap radius to increase in a like manner, it is to be understood that it is also possible to achieve somewhat similar results by maintaining one of gap length or gap radius constant, while varying the other parameter. However, it is somewhat difficult, in these alternative instances, to provide uniform initial power dissipation in all of the gaps along the length of the discharge.

In the preferred embodiment, fuel mass 34 and oxidizer mass 35 are respectively solid, powder polyethylene ($CH_2$) and ammonium nitrate ($NH_4NO_3$) in solid or solution form. The power of the plasma produced by structure 32 is sufficiently great as to produce a high enough temperature to start a vaporization process of the $NH_4NO_3$ only a few microseconds after power supply 26 supplies a pulse to structure 32. The portion of the polyethylene fuel closest to projectile 30, in the gap between rings 50.1 and 50.2 is initially vaporized because the greatest plasma power and temperature are initially produced in this gap, after the initial constant pressure interval. In response to vaporization of the polyethylene in the gap between rings 50.1 and 50.2, the previously described exothermal chemical reaction occurs as a result of the vaporized fuel being forced radially away from structure 32 by the high pressure plasma. Another option is to use carbon electrodes, in which case carbon is vaporized from the electrodes and the walls of the gap between rings 50.1 and 50.2 and flows as a gas radially into oxidizer mass 35 to exothermally react with the oxidizer in accordance with: $C+2NH_4NO_3 \rightarrow CO_2+2N_2+4H_2O+850$ kJ/mole of reaction products. Because of covers 56 the flow of liquid metal into the reaction is largely inhibited, to minimize interference with the gaseous reactant. The gaseous products of the two reactions combine and flow through the outlet of the cartridge created by breaking diaphragm 104; these gases flow against projectile 30 to accelerate the projectile down barrel 18.

After the reactions of the fuel mass 34 in closest proximity to the gap between rings 50.1 and 50.2 and of the carbon on the walls of these rings have been initiated, similar reactions occur in response to vaporization of the fuel mass and of carbon on the walls of the rings in the gap between rings 50.2 and 50.3. Thereby, progressive vaporizations of the fuel masses as a function of distance from projectile 30 occurs, with concomitant progressive chemical reactions to provide progressive regions having no solid or liquid materials therein to impede the flow of the gaseous reaction products to the projectile. As the reactions occur, the fuel and oxidizer progressively move toward the forward end of the cartridge, into greater proximity with the outlet through broken diaphragm 104. It is important for the fuel to be confined to close proximity to the discharges between rings 50 to provide adequate heat transfer for the fuel which has a relatively high vaporization temperature.

To assist in directing the gaseous reaction products toward the rear of projectile 30, the interior wall of housing 102 (coaxial with axis 42) is tapered, as illustrated in FIG. 2, toward diaphragm 104 to form a nozzle-like effect. Such an arrangement causes liquid oxidizer toward the rear of the cartridge to be metered toward the opening formed by broken diaphragm 104 to interact with and be vaporized by the high power plasma flowing radially away from structure 32. An advantage of using a liquid as oxidizer mass 35 is that liquid can be pumped into the cartridge when needed in the field. In addition, the liquid oxidizer can be loaded into the cartridge with greater density than a particulate solid; however, there is greater mixing of solid particulate oxidizer with the powdered fuel during the reaction than is attained with liquid oxidizer.

Figure 4:
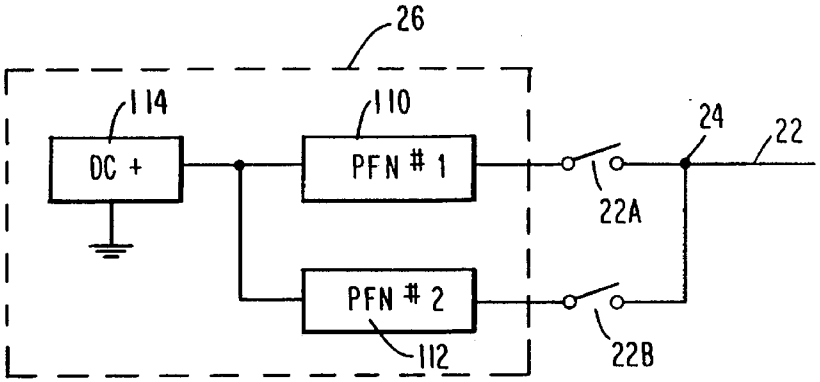
FIG. 4 is a block diagram of a power supply for energizing the cartridge of FIGS. 1–3.
Figure 5A:
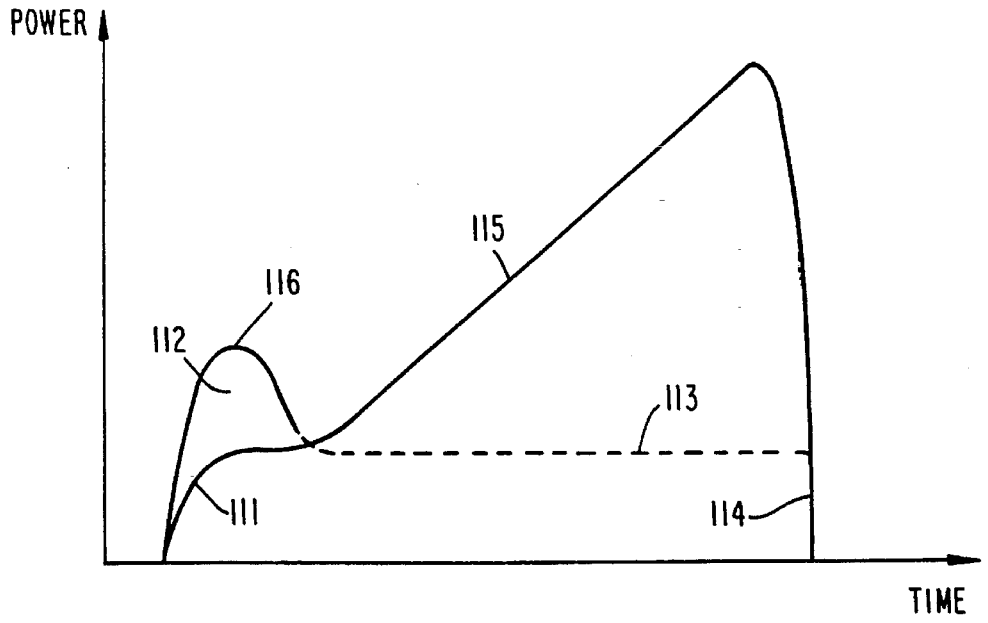
FIGS. 5A and 5B are electrical and pressure waveforms resulting from energy of the power supply of FIG. 4 being supplied to the structure of FIGS. 1 and 2.

A preferred embodiment of high voltage pulse power supply 26 is illustrated in FIG. 4 as including high voltage, high power pulse forming networks 110 and 112, which are precharged by high voltage DC power supply 114. FIG. 5A is a waveform of the power at terminal 24 for an interval beginning with closure of contacts 22 (FIG. 1) until approximately 1025 microseconds after the closure. This is the typical time for a 30 mm gun. Longer times are used for larger guns. Output terminals of pulse forming networks 110 and 112 are connected to output terminal 24 of high voltage pulse supply 26 so the voltages of the pulse forming networks are added at terminal 24. To independently control coupling of the outputs of networks 110 and 112 to terminal 24, contacts 22 actually include separate contacts 22A and 22B respectively connected between the outputs of networks 110 and 112 and terminal 24. In accordance with one embodiment, pulse forming network 110 initially produces a pulse having a power vs. time variation (FIG. 5A) having an initial relatively steep slope segment 111 followed by a rounded portion 112, followed by a relatively constant segment 113, in turn followed by steep trailing edge 114. In contrast, pulse forming network 112 produces a ramping, approximately linear power output wave segment 115 that drops quickly to zero after reaching a maximum value; the drop to zero occurs about the time the output of network 112 drops to zero during wave portion 114. Alternatively, as indicated by dotted waveform segment 116, network 110 produces a wave segment 116 having a peak output power that exceeds that of segment 113 and then decreases at a rate about equal to the rate of change of wave segment 111 back to segment 113. In the alternate arrangement, network 112 produces an output having the same variation as in the described embodiment. Power pulse segment 116 is needed in certain instances to initially fill the chamber volume with pressured gas near the peak pressure needed to accelerate projectile 30.

Figure 5B:
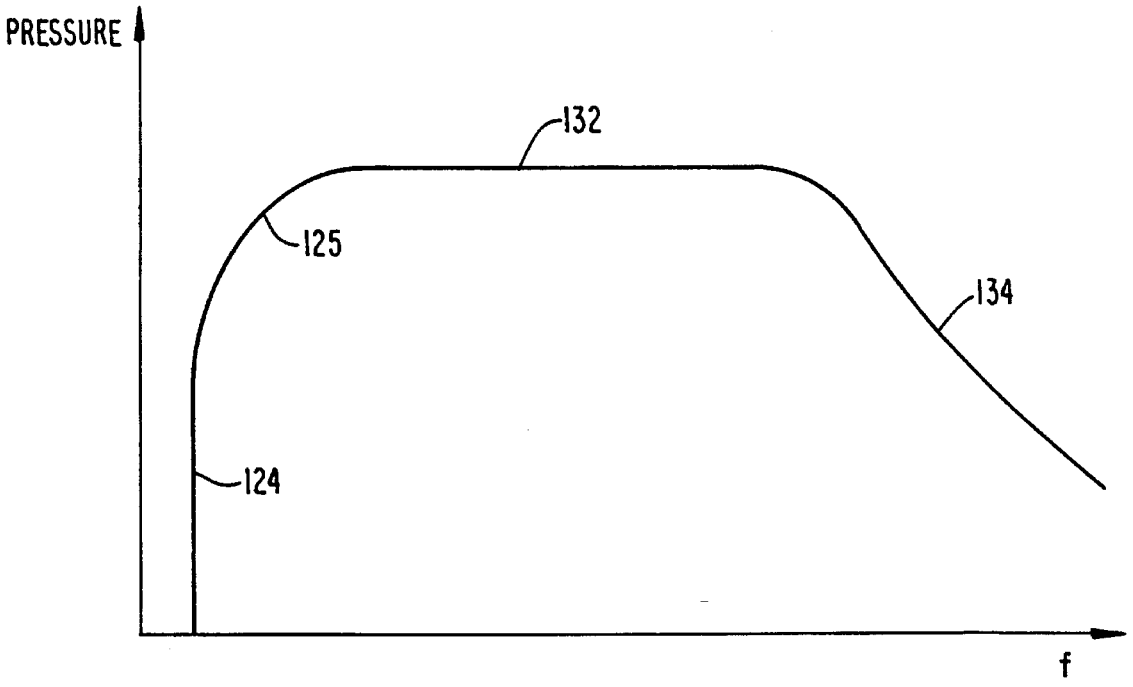

The steep leading edge of wave segment 111 at the output of pulse forming network 110 ruptures wires 64 in gaps 62 and then causes a high pressure plasma pulse to be produced in the gaps between rings 50, as well as in the gap between ring 50.12 and sleeve 52. Initially, this plasma is rapidly produced, so there is an initial large rate of change of pressure against the base of projectile 30, as indicated by waveform segment 124, FIG. 5B, wherein pressure at the base of projectile 30 is plotted as a function of time. Wave segment 124 is followed by gradual transition wave segment 125.

To maintain the pressure applied to the base of projectile 30 approximately constant for the entire approximately 1000 microsecond interval while the projectile is being accelerated in bore 18, as indicated by waveform segment 132, the output of pulse forming network 112 includes upwardly ramping power segment 115. The pressure against the projectile decreases as indicated by waveform segment 134, immediately after the trailing edges of the outputs of networks 110 and 112 occur. Preferably, these trailing edges are timed to coincide with projectile 30 passing through the muzzle of barrel 18. The increased plasma in gaps 62 resulting from ramp portion 113 of the output of pulse forming network 112 applies added pressure to the projectile and vaporizes additional portions of fuel mass 34. The cumulative effects are such that the combined pressure on the base of projectile 30 remains relatively constant, despite the increasing volume in bore 18 between the outlet of cartridge 10 and the base of the projectile as it traverses barrel 16. Pulse forming network 112 produces ramping power and pressure variations, rather than step-like power and pressure variations to prevent an over-pressure in barrel 16 that could have detrimental and possibly destructive effects on gun 14.

While there have been described and illustrated specific embodiments of the invention, it will be clear that variations in the details of the embodiments specifically illustrated and described may be made without departing from the true spirit and scope of the invention as defined in the appended claims. For example, several of the described structures can be arranged in parallel relationship such that the gas flows from the several structures are combined to produce a higher pressure pulse, as disclosed in commonly assigned U.S. Pat. No. 5,072,647.

I claim:

1. Apparatus for accelerating a projectile along a gun barrel having a longitudinal axis comprising a structure for establishing at least several axial gaps for providing at least several axial electrical discharges behind the projectile, the discharges causing plasma to flow with components at right angles to the axial discharges for a substantial time while the projectile is traversing the barrel, a propellant mass positioned to be responsive to the plasma flow resulting from the discharges, the propellant mass being converted into a high pressure gas for accelerating the projectile in the barrel in response to the plasma resulting from the discharges being incident on the propellant mass, the propellant mass including a solid fuel and an oxidizer that do not react at ambient conditions, a portion of the fuel abutting the structure, the fuel and oxidizer being vaporized and elevated to a sufficiently high temperature by the plasma as to produce an exothermic chemical reaction resulting in derivation of the high pressure gas pulse that is supplied to the projectile, the axial gaps being arranged so that the power applied to the plasma via gaps close to the projectile causes initial vaporization of the fuel closest to the projectile prior to vaporization of the fuel farther from the projectile and progressive vaporization of the fuel farther from the projectile.

2. The apparatus of claim 1 wherein the gaps are arranged so greater power is applied to gaps close to the projectile than is applied to gaps farther from the projectile.

3. The apparatus of claim 1 wherein the fuel mass is a solid confined to a region in proximity to the discharges and the oxidizer is in a second region radially beyond the confined region where the fuel is located.

4. The apparatus of claim 3 wherein the oxidizer is a liquid in the confined and second regions.

5. The apparatus of claim 4 wherein the fuel is a powder confined by a screen having a mesh less than the size of grains of the powder.

6. The apparatus of claim 4 wherein the oxidizer is a solid confined to the second region.

7. The apparatus of claim 6 wherein the fuel is a powder, the fuel and the oxidizer being confined by a screen having a mesh less than the size of grains of the powder.

8. The apparatus of claim 3 wherein the confined fuel mass decreases in cross sectional area along the structure as distance of the structure from the projectile increases.

9. The apparatus of claim 8 wherein the gaps include walls that erode differently in response to the discharges so that the walls of the gaps close to the projectile erode faster than the walls of the gaps farther from the projectile, the walls being on rings coaxial with an axis of the structure, the rings having diameters such that rings close to the projectile have smaller diameters than rings remote from the projectile, the screen having a cylindrical constant diameter wall coaxial with the rings.

10. The apparatus of claim 9 wherein the structure, screen, fuel mass and oxidizer mass are in a cartridge having circular cross sections that are coaxial with the rings and tapered toward the projectile so that the cross sections close to the projectile have smaller radii than cross sections remote from the projectile to form a nozzle-like structure for the fuel mass and the oxidizer in fluid form.

11. The apparatus of claim 8 wherein the combined fuel mass and oxidizer mass are in a housing having interior walls configured as a nozzle-like structure for directing the fuel mass and the oxidizer in fluid form toward the projectile.

12. The apparatus of claim 2 wherein the gaps include walls that erode differently in response to the discharges so that the walls of the gaps close to the projectile erode faster than the walls of the gaps farther from the projectile.

13. The apparatus of claim 12 wherein the walls include a solid material that is vaporized by the discharge and exothermally reacts chemically with the oxidizer to produce a portion of a high pressure gas pulse that is applied to the projectile.

14. The apparatus of claim 12 wherein the walls of the gaps close to the projectile have a smaller radius than walls of the gaps farther from the projectile.

15. The apparatus of claim 14 wherein the walls of the gaps close to the projectile are axially closer to each other than the walls of the gaps farther from the projectile.

16. The apparatus of claim 12 wherein the walls of the gaps close to the projectile are axially closer to each other than the walls of the gaps farther from the projectile.

17. The apparatus of claim 12 wherein each wall is part of a member having an outer periphery beyond the wall, the outer periphery being a cover for the portion of the member including the wall and being formed of a material that is eroded by the plasma at a rate which is much slower than the wall.

18. The apparatus of claim 17 wherein the cover material is an electric insulator.

19. The apparatus of claim 18 wherein the portion of the member including the wall is carbon.

20. The apparatus of claim 1 wherein the discharges are established between metal portions of the structure.

21. The apparatus of claim 20 wherein the gaps include walls that erode differently in response to the discharges so that the walls of the gaps close to the projectile erode faster than the walls of the gaps farther from the projectile.

22. Apparatus for supplying a high pressure pulse of gas along a longitudinal axis to an outlet port, comprising a structure for establishing at least several axial gaps for providing at least several axial electrical discharges behind the outlet port, the discharge causing plasma to flow with components at right angles to the axial discharges, a propellant mass positioned to be responsive to the plasma flow resulting from the discharges, the propellant mass being converted into a component of the high pressure gas pulse by the plasma flow, the gaps including walls that erode differently in response to the discharges so that the walls of the gaps close to the outlet erode faster than the walls of the gaps farther from the outlet, the propellant mass including a solid fuel and an oxidizer that do not react at ambient conditions, a portion of the fuel abutting the structure, the fuel and oxidizer being vaporized and elevated to a sufficiently high temperature by the plasma as to produce an exothermic chemical reaction resulting in derivation of the high pressure gas pulse that is supplied to the outlet.

23. The apparatus of claim 22 wherein the walls of the gaps close to the outlet have a smaller radius than walls of the gaps farther from the outlet.

24. The apparatus of claim 23 wherein the walls of the gaps close to the outlet are axially closer to each other than the walls of the gaps farther from the outlet.

25. The apparatus of claim 22 wherein the walls of the gaps close to the outlet are axially closer to each other than the walls of the gaps farther from the outlet.

26. A cartridge to be loaded into a gun barrel comprising a projectile, a propelling structure for the projectile, the projectile and propelling structure being attached to each other, the propelling structure establishing at least several axial gaps for providing at least several axial electrical discharges behind the projectile, the discharges causing plasma to flow with components at right angles to the axial discharges for a substantial time while the projectile is traversing the barrel, a propellant mass positioned to be responsive to the plasma flow resulting from the discharges, the propellant mass being converted into a high pressure gas for accelerating the projectile in the barrel in response to the plasma resulting from the discharges being incident on the propellant mass, the propellant mass including a solid fuel and an oxidizer that do not react at ambient conditions, a portion of the fuel abutting the structure, the fuel and oxidizer being vaporized and elevated to a sufficiently high temperature by the plasma as to produce an exothermic chemical reaction resulting in derivation of the high pressure gas pulse that is supplied to the projectile, the axial gaps being arranged so that the power applied to the plasma via gaps close to the projectile causes initial vaporization of the fuel closest to the projectile prior to vaporization of the fuel farther from the projectile and progressive vaporization of the fuel farther from the projectile.

27. A cartridge to be loaded into a gun barrel comprising a projectile, a propelling structure for the projectile, the projectile and propelling structure being attached to each other, the propelling structure establishing at least several axial gaps for providing at least several axial electrical discharges behind the projectile, the discharges causing plasma to flow with components at right angles to the axial discharges, a propellant mass positioned to be responsive to the plasma flow resulting from the discharges, the propellant mass being converted into a high pressure gas for accelerating the projectile in the barrel in response to the plasma resulting from the discharges being incident on the propellant mass, the gaps including walls that erode differently in response to the discharges so that the walls of the gaps close to the projectile erode faster than the walls of the gaps farther from the projectile, the propellant mass including a solid fuel and an oxidizer that do not react at ambient conditions, a portion of the fuel abutting the structure, the fuel and oxidizer being vaporized and elevated to a sufficiently high temperature by the plasma as to produce an exothermic chemical reaction resulting in derivation of the high pressure gas pulse that is supplied to the projectile.

* * * * *